US009005518B2

(12) United States Patent
Barrett et al.

(10) Patent No.: US 9,005,518 B2
(45) Date of Patent: Apr. 14, 2015

(54) HIGH YIELD LADLE BOTTOMS

(75) Inventors: Ronald Barrett, Fenelton, PA (US); Donald Abrino, Curwensville, PA (US)

(73) Assignee: North American Refractories Co., Moon Township, PA (US)

( * ) Notice: Subject to any disclaimer, the term of this patent is extended or adjusted under 35 U.S.C. 154(b) by 353 days.

(21) Appl. No.: 13/360,858

(22) Filed: Jan. 30, 2012

(65) Prior Publication Data

US 2012/0126467 A1 May 24, 2012

Related U.S. Application Data

(63) Continuation-in-part of application No. 12/032,720, filed on Feb. 18, 2008, now Pat. No. 8,110,142.

(51) Int. Cl.

| | |
|---|---|
| ***C21C 5/44*** | (2006.01) |
| ***B22D 41/08*** | (2006.01) |
| ***B22D 41/02*** | (2006.01) |
| ***F27D 1/00*** | (2006.01) |
| ***F27D 1/04*** | (2006.01) |
| ***F27D 1/10*** | (2006.01) |

(52) U.S. Cl.

CPC ..... *B22D 41/02* (2013.01); *F27D 1/0043* (2013.01); *F27D 1/04* (2013.01); *F27D 1/10* (2013.01)

(58) Field of Classification Search

USPC ..... 266/200, 236, 274, 275, 283; 222/590, 222/591, 594

See application file for complete search history.

(56) References Cited

U.S. PATENT DOCUMENTS

| | | | | |
|---|---|---|---|---|
| 3,352,465 | A | 11/1967 | Shapland | 222/600 |
| 3,516,478 | A | 6/1970 | Dunn et al. | 164/423 |
| 3,603,050 | A | 9/1971 | Coleman | 52/249 |
| 4,360,133 | A | 11/1982 | Debaise | 222/590 |
| 4,601,415 | A | 7/1986 | Koffron | 222/597 |
| 4,709,903 | A | 12/1987 | LaBate | 266/227 |
| 4,746,102 | A | 5/1988 | Gilles et al. | 266/236 |
| 4,968,007 | A | 11/1990 | Forte et al. | 266/100 |
| 5,171,513 | A | 12/1992 | Vassilicos | 266/230 |
| 5,196,051 | A | 3/1993 | Heaslip et al. | 75/582 |
| 5,382,003 | A | 1/1995 | Sankaranarayanan et al. | 266/230 |
| RE35,597 | E | 8/1997 | Vassilicos | 266/230 |
| 5,879,616 | A | 3/1999 | Erny | 266/45 |
| 5,948,349 | A | 9/1999 | Beurotte et al. | 266/44 |
| RE37,417 | E | 10/2001 | Koffron | 266/230 |
| 6,673,306 | B2 | 1/2004 | Abrino et al. | 266/275 |
| 6,723,275 | B2 | 4/2004 | Koffron et al. | 266/45 |
| 6,787,098 | B2 | 9/2004 | Abrino et al. | 266/44 |
| 7,112,300 | B2 | 9/2006 | Richard et al. | 266/275 |
| 8,110,142 | B2 | 2/2012 | Barrett et al. | 266/283 |
| 2002/0153645 | A1 | 10/2002 | Abrino et al. | 266/280 |
| 2005/0127582 | A1 | 6/2005 | Richaud et al. | 266/200 |
| 2007/0029708 | A1 | 2/2007 | Richaud et al. | 266/200 |
| 2007/0132162 | A1 | 6/2007 | Barrett | 266/283 |
| 2009/0166387 | A1 | 7/2009 | Bigelow et al. | 222/590 |

*Primary Examiner* — Lois Zheng

(74) *Attorney, Agent, or Firm* — Kusner & Jaffe

(57) ABSTRACT

A refractory bottom lining for lining the bottom of a metallurgical vessel. The refractory bottom includes a stepped portion and an impact portion. The impact portion is formed of a first refractory material. The stepped portion is formed of a second refractory material and is disposed around the impact portion. The stepped portion includes an upper surface that has a plurality of discrete surface sections. The plurality of discrete surface sections includes an uppermost surface section, at least two intermediate surface sections and a lowermost surface section. Each surface section has a different elevation such that the uppermost surface section has a highest elevation and the lowermost surface section has a lowest elevation. The uppermost surface section, the at least two intermediate surface sections and the lowermost surface section define a continuously downward stepped path from the uppermost surface section to the lowermost surface section.

28 Claims, 11 Drawing Sheets

HIGH YIELD LADLE BOTTOMS

RELATED APPLICATIONS

This application is a continuation-in-part of U.S. application Ser. No. 12/032,720, filed Feb. 18, 2008 now U.S. Pat. No. 8,110,142.

FIELD OF THE INVENTION

The present invention relates generally to refractory linings for metallurgical vessels, and more particularly to a lining bottom for such vessels. The invention is particularly applicable for use in ladles used in handling molten steel, and will be described with particular reference thereto. It will, of course, be appreciated that the present invention has application in other types of metallurgical vessels for handling molten metal.

BACKGROUND OF THE INVENTION

In the manufacture of steel, molten steel is poured from a metallurgical furnace into a ladle. In pouring the liquid metal from the metallurgical furnace, there is typically some carry-over of slag from the furnace into the ladle. The molten steel may also undergo further refinement in the ladle. In this respect, various slag-forming constituents may be added to the liquid steel in the ladle to aid in the refinement process. Thus, the ladle will typically contain molten steel with a layer of slag floating on top of the steel.

The molten steel typically is cast, i.e., drained, from the ladle through a well block in a bottom of the ladle. A slide gate or stopper rod serves to open a channel through which the liquid metal exits the ladle. During the casting process, slag particles can become entrained in the stream of liquid steel exiting the ladle. Entrainment can be caused by vortexing, i.e., swirling, in the vicinity of the well block. Vortexing may occur once the level of the liquid metal in the ladle drops to a critical level. The level of steel in the ladle will eventually drop to a point where slag may also be pulled directly into the stream of liquid steel exiting the ladle, even in the absence of vortexing. The slag particles cause contamination of the liquid metal thereby causing the resulting steel to be of lower quality.

To avoid contamination of the steel by slag, casting is generally terminated before the level of liquid metal in the ladle reaches the critical level at which slag may be entrained. This results in a certain amount of liquid metal being left in the ladle. This residual liquid metal represents lost production, and is referred to as a "decrease in yield." To increase yield, steelmakers endeavor to allow the level of the liquid steel in the ladle to fall to as low a level as possible before stopping the casting operation.

The present invention provides a ladle bottom that increases the yield of slag-free steel from a steel-making ladle and reduces the entrainment of slag into the stream of liquid metal.

SUMMARY OF THE INVENTION

In accordance with the present invention, there is provided a refractory bottom for a metallurgical vessel comprised of a bottom lining having a bottom surface that is dimensioned to overlay a bottom of a metallurgical vessel and an upper surface. The upper surface is comprised of a plurality of discrete sections that include an uppermost section, an intermediate section and a lowermost section. Each section has an upper surface at a discrete elevation such that the upper surface of the uppermost section has a highest elevation and the upper surface of the lowermost section has a lowest elevation. The upper surface of the uppermost section, the intermediate section and the lowermost section comprise a series of successive stepped sections that define a stepped path from the uppermost section downward to the lowermost section. Each successive section of the upper surface is lower than a preceding section. An opening extends through the lowermost section of the bottom lining to allow a molten metal to drain from the vessel.

In accordance with another aspect of the present invention, there is provided a refractory bottom for a metallurgical vessel comprised of a bottom lining. The bottom lining has an upper surface comprised of an uppermost section, an intermediate section and a lowermost section. The sections define a path from the uppermost section to the lowermost section. The path is comprised of successive stepped sections. Each section defines a step in the path and each successive step is lower than a preceding step. An opening extends through the lowermost section of the bottom lining to allow molten metal to drain from a metallurgical vessel.

In accordance with yet another aspect of the present invention, there is provided a refractory bottom lining for a metallurgical vessel. The metallurgical vessel has a bottom and a side wall. The bottom lining has a bottom surface that is dimensioned to overlay the bottom of the metallurgical vessel. An outer peripheral edge is dimensioned to be spaced from the side wall of the metallurgical vessel. An impact portion is formed of a first refractory material. The impact portion has an upper surface and an outer peripheral edge. A stepped portion is formed of a second refractory material. The stepped portion is disposed around the outer peripheral edge of the impact portion. The stepped portion has an upper surface comprising a plurality of discrete surface sections including an uppermost surface section, at least two intermediate surface sections and a lowermost surface section. The uppermost surface section, the at least two intermediate surface sections and the lowermost surface section are disposed around a periphery of the impact portion such that the upper surface of the impact portion is spaced from the outer peripheral edge of the bottom lining. Each surface section of the upper surface is disposed at a different elevation wherein the uppermost surface section has a highest elevation, the lowermost surface section has a lowest elevation, and the at least two intermediate surface sections each have an intermediate elevation that is different from each other and are disposed between the highest elevation and the lowest elevation. All of the discrete surface sections forming the upper surface of the stepped portion are arranged in elevation-descending order from the uppermost surface section to the lowermost surface section to define a continuously downward stepped path from the uppermost surface section to the lowermost surface section. Each successive surface section along the continuously downward stepped path is lower than a preceding surface section in the continuously downward stepped path. An opening extends through the lowermost surface section of the stepped portion to allow a molten metal to drain from the metallurgical vessel.

In accordance with still another aspect of the present invention, there is provided a refractory bottom lining for lining a bottom of a metallurgical vessel having a side wall. The bottom lining is a three-dimensional structure that is formed of a refractory material and has a bottom surface that is dimensioned to overlay the bottom of the metallurgical vessel. An outer peripheral edge is dimensioned to be spaced from the side wall of the metallurgical vessel. A stepped portion is formed of a first refractory material. The stepped portion has an upper surface comprising a plurality of discrete surface sections including an uppermost surface section, at least two intermediate surface sections and a lowermost surface section. Each surface section of the upper surface is disposed at a different elevation wherein the uppermost surface section has a highest elevation, the lowermost surface section has a lowest elevation, and the intermediate surface sections each have an intermediate elevation that is different from each other and disposed between the highest elevation and the lowest elevation. All of the discrete surface sections forming the upper surface of the stepped portion are arranged in elevation-descending order from the uppermost surface section to the lowermost surface section to define a continuously downward stepped path from the uppermost surface section to the lowermost surface section. Each successive surface section along the continuously downward stepped path is lower than a preceding surface section in the continuously downward stepped path. An opening extends through the lowermost surface section of the stepped portion to allow a molten metal to drain from the metallurgical vessel. A raised curb is disposed on the lowermost surface section of the stepped portion. The raised curb extends from the opening to a location on the lowermost surface section. The location is spaced from an adjacent intermediate surface section. The raised curb has a first side spaced from the outer peripheral edge of the bottom lining and a second side spaced from the uppermost surface section.

In accordance with another aspect of the present invention, there is provided a refractory bottom lining for lining a bottom of a metallurgical vessel. The bottom lining is a three-dimensional structure formed of a refractory material and has a bottom surface that is dimensioned to overlay the bottom of the metallurgical vessel. A stepped portion of the refractory bottom is formed of a first refractory material. The stepped portion has an upper surface comprised of an uppermost surface section, at least two intermediate surface sections and a lowermost surface section. The surface sections of the upper surface are arranged in elevation-descending order from the uppermost surface section to the lowermost surface section to define two continuously downward stepped paths from the uppermost surface section to the lowermost surface section. Each successive surface section along each of the two continuously downward stepped paths is lower than a preceding surface section in the continuously downward stepped path. The surface sections are disposed such that a first of the two continuously downward stepped paths is curved in a counter-clockwise direction and a second of the two continuously downward stepped paths is curved in a clockwise direction. An opening extends through the lowermost surface section of the stepped portion to allow a molten metal to drain from the metallurgical vessel.

An advantage of the present invention is the provision of a refractory bottom lining for a ladle used in a steel making process Another advantage of the present invention is the provision of a refractory bottom lining, as described above that aids in the flow of molten metal in the ladle as the molten metal is drained from the ladle.

Another advantage of the present invention is the provision of a bottom lining, as described above that is designed to minimize the amount of slag entrained in the molten metal as the molten metal is drained from the ladle.

A still further advantage of the present invention is the provision of a bottom lining, as described above that captures slag on sections of the bottom lining as the molten metal is drained from the ladle.

Still another advantage of the present invention is the provision of a bottom lining, as described above that reduces the volume of molten metal remaining in the ladle when the flow of molten metal from the ladle ceases.

Still another advantage of the present invention is the provision of a bottom lining, as described above that increases a yield of molten metal by allowing more slag-free, molten metal to be drained from the ladle.

Yet another advantage of the present invention is the provision of a bottom lining, as described above that creates two (2) distinct flow paths at a drain opening to retard the formation of a vortex at the drain opening.

These and other advantages will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF THE INVENTION

Figure 1:
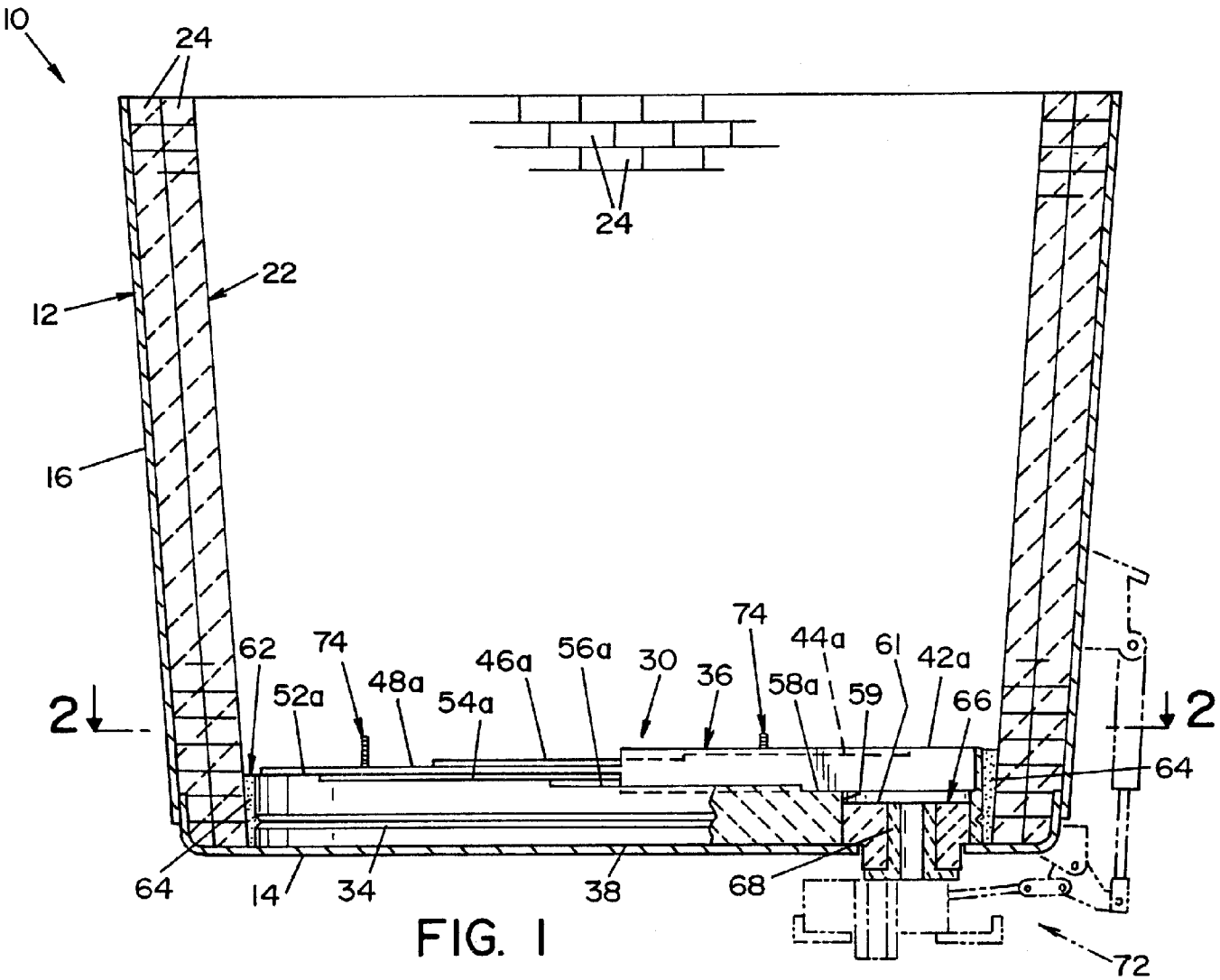
FIG. 1 is a side, sectional view of a ladle for handling molten metal, showing a bottom lining of the ladle according to a first embodiment of the present invention.

Referring now to the drawings wherein the showings are for the purposes of illustrating preferred embodiments of the invention only and not for the purposes of limiting the same, the present invention relates generally to a refractory lining for a metallurgical vessel. The invention is particularly applicable to a steel ladle used in handling molten steel, and will be described in particular reference thereto. It will be appreciated from a further reading of the specification, that the invention is not limited to a steel ladle, but may find advantageous application for linings used in other types of metallurgical vessels handling molten metal.

FIG. 1 shows a conventional steel ladle 10 generally comprised of an outer metallic shell 12. Shell 12 has a cup-shaped bottom 14 and a slightly conical side wall 16. A refractory lining 22, comprised of two layers of refractory brick 24, is disposed along the inner surface of side wall 16. In the embodiment shown, refractory lining 22 of refractory bricks 24 extends along the entire length of side of wall 16 from bottom 14 to the open upper end of ladle 10, as best seen in FIG. 1.

A bottom lining 30 (best seen in FIG. 3) is dimensioned to be disposed on bottom 14 of metallic shell 12. Bottom lining 30 is basically comprised of a refractory material. In this respect, bottom lining 30 may be comprised of a refractory castable, refractory bricks or a combination of a refractory castable and refractory bricks.

Bottom lining 30 is dimensioned to cover and rest upon bottom 14 of shell 12. In the embodiment shown, bottom lining 30 is essentially oblong in shape, and is dimensioned to have a lower surface 38. Lower surface 38 is dimensioned to match oblong bottom 14 of shell 12. A V-shaped slot 34, best seen in FIG. 3, is formed in the peripheral edge of bottom lining 30 to secure bottom lining 30 in ladle 10, as shall be described in greater detail below.

Figure 2:
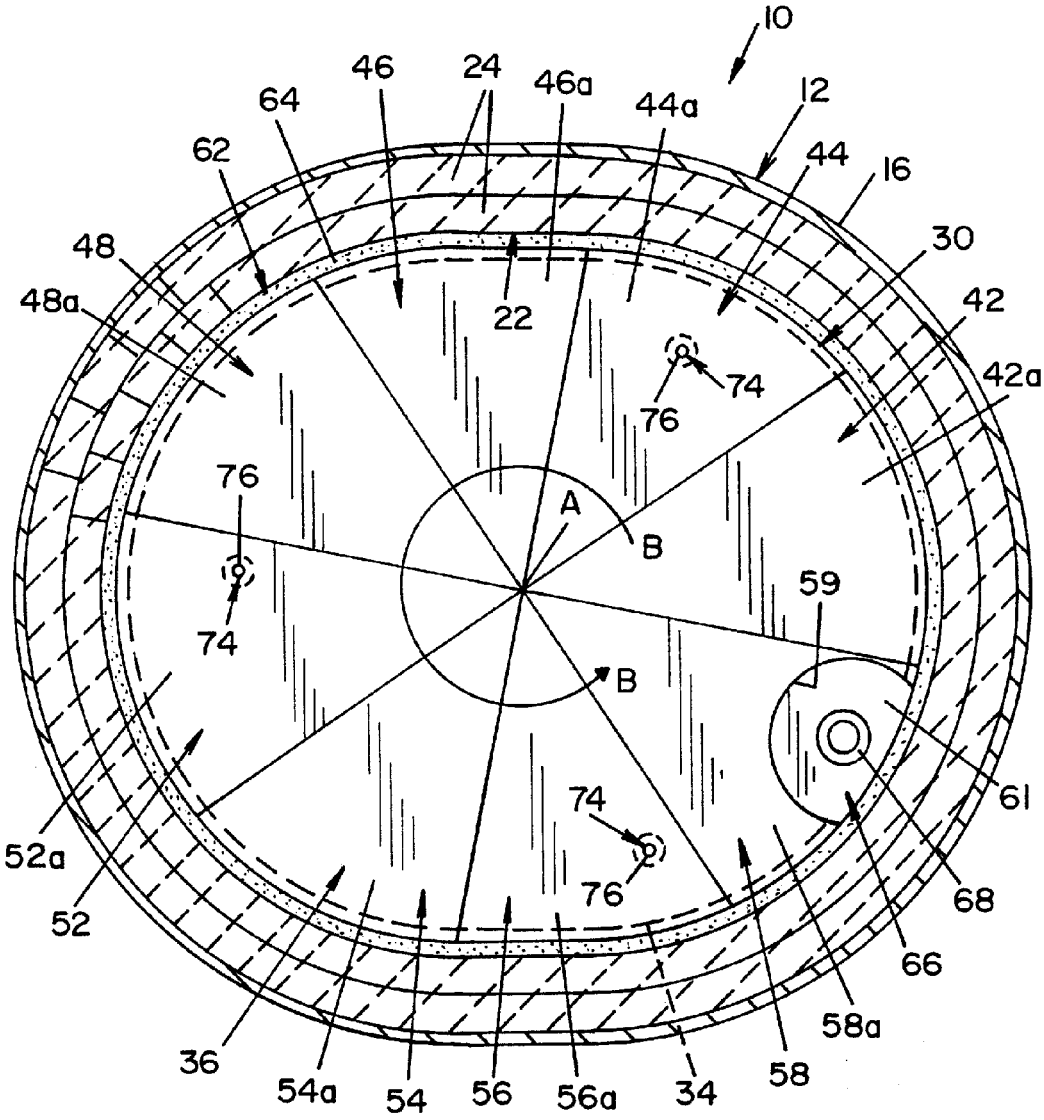
FIG. 2 is a sectional view taken along lines 2-2 of FIG. 1.
Figure 3:
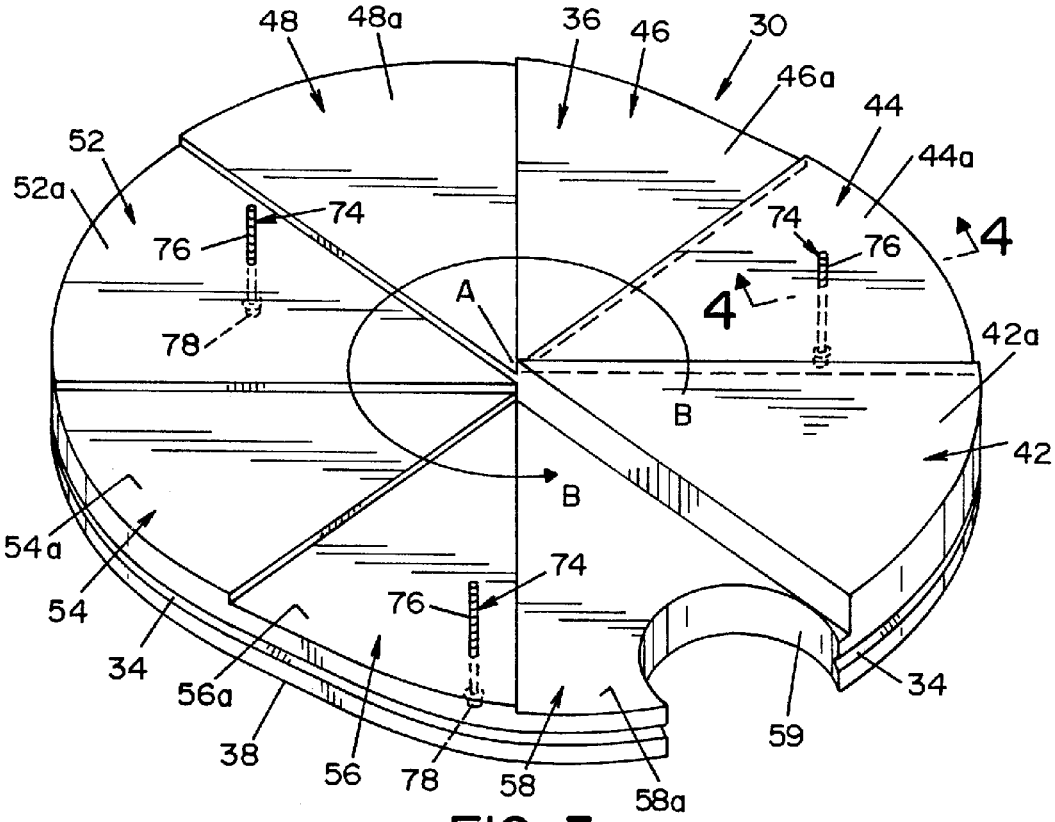
FIG. 3 is a perspective view of a bottom lining as shown in FIGS. 1 and 2.

Referring now to FIGS. 1-3, bottom lining 30, illustrating a first embodiment of the present invention, is shown. Bottom lining 30 has an upper portion comprised of discrete sections. In the embodiment shown, the upper portion of bottom lining 30 is comprised of an uppermost section 42, six (6) intermediate sections 44, 46, 48, 52, 54, 56 and a lowermost section 58. Uppermost section 42, intermediate sections 44, 46, 48, 52, 54, 56 and lowermost section 58 are each basically pie-shaped. Uppermost section 42, intermediate sections 44, 46, 48, 52, 54, 56 and lowermost section 58 are arranged such that each section extends from a center point "A," best seen in FIG. 2. An opening 59 extends through the portion of bottom lining 30 defining lowermost section 58. Uppermost section 42 has an upper surface 42*a*, intermediate section 44 has an upper surface 44*a*, intermediate section 46 has an upper surface 46*a*, and so forth. Surfaces 42*a*, 44*a*, 46*a*, 48*a*, 52*a*, 54*a*, 56*a*, 58*a* are each disposed at a discrete elevation and combine to form an upper surface 36 of bottom lining 30. In the embodiment shown, surfaces 42*a*, 44*a*, 46*a*, 48*a*, 52*a*, 54*a*, 56*a*, 58*a* are each parallel and horizontal when ladle 10 is in a normal operating orientation. Surface 42*a* has an elevation higher than an elevation of surfaces 44*a*, 46*a*, 48*a*, 52*a*, 54*a*, 56*a*, 58*a*. Surfaces 44*a*, 46*a*, 48*a*, 52*a*, 54*a*, 56*a* are each dimensioned to have a different elevation such that surface 44*a* is higher than surface 46*a*, surface 46*a* is higher than surface 48*a*, and so forth until surface 56*a*, that has an elevation less than surfaces 44*a*, 46*a*, 48*a*, 52*a*, 54*a*. Surface 58*a* has an elevation lower than surface 56*a*. Surfaces 42*a*, 44*a*, 46*a*, 48*a*, 52*a*, 54*a*, 56*a*, 58*a* are arranged to form a series of successive steps, wherein each surface steps downwardly from surface 42*a*, to surfaces 44*a*, 46*a*, 48*a*, 52*a*, 54*a*, 56*a* to surface 58*a*.

In the embodiment shown, bottom lining 30 is formed by molding sections 42, 44, 46, 48, 52, 54, 56, 58 using a single mold (not shown) or using conventionally known forms (not shown). For the method wherein bottom lining 30 is formed in a single mold, a bottom of the mold is dimensioned to match upper surface 36. In this respect, when a refractory material is poured into the mold, upper surface 36 of bottom lining 30 is formed in the bottom of the mold. Bottom lining 30 is then removed from the mold and inverted such that upper surface 36 of bottom lining 30 faces upward. For the method of forming bottom lining 30 using conventional forms, lowermost section 58 is formed first. Conventionally known forms are then used to aid in forming the remaining sections 42, 44, 46, 48, 52, 54, 56 of bottom lining 30 starting with intermediate section 56, then intermediate section 54 and so forth.

Refractory material, used to form bottom lining 30, is selected based upon the desired operating characteristics and performance parameters of bottom lining 30. Various high-temperature refractory castables may find advantageous application in the present invention. In the embodiment of the present invention wherein bottom lining 30 is a monolithic, refractory slab, a low-moisture, high alumina castable, manufactured and sold by North American Refractories Co. under the trade designations D-CAST 85 GOLD or HP-CAST ULTRA is used. Castables having 80% alumina content or higher are preferred. In an embodiment wherein bottom lining 30 is comprised of refractory bricks, an alumina-magnesia-carbon brick, manufactured and sold by North American Refractories Co, under the trade designations COMANCHE FA or COMANCHE FA MX may be used.

Figure 4:
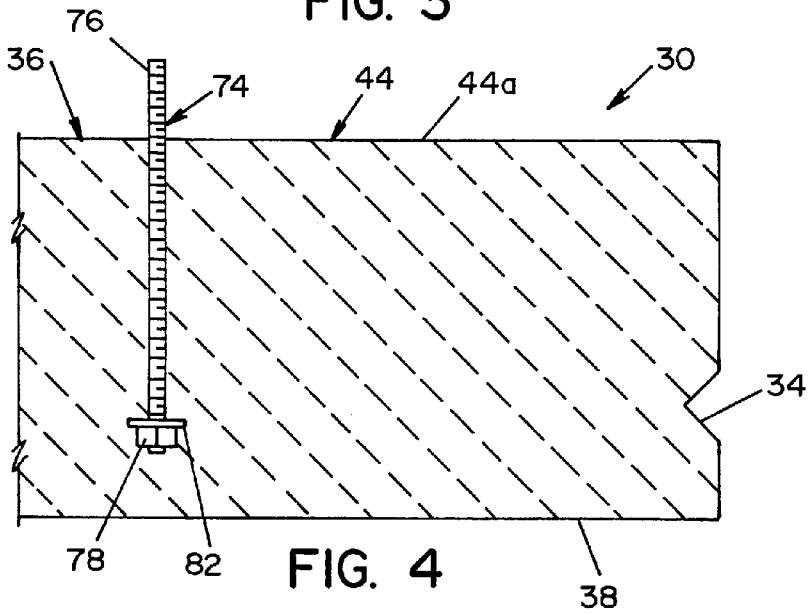
FIG. 4 is a sectional view taken along lines 4-4 of FIG. 3, showing a cross-section of the bottom lining.

Spaced-apart lifting pin assemblies 74 are embedded within bottom lining 30, as best seen in FIG. 4, when bottom lining 30 is formed. Each lifting pin assembly 74 is basically comprised of a threaded rod 76 that is threaded into a matching nut 78 that in turn is welded to a flat metallic washer 82. Several lifting pin assemblies 74 are set into bottom lining 30 at spaced-apart locations when bottom lining 30 is formed. Pin assemblies 74 facilitate movement of bottom lining 30 from its point of fabrication to its ultimate location within ladle 10.

U.S. Pat. No. 6,673,306 entitled "Refractory Lining For Metallurgical Vessel" and U.S. Pat. No. 6,787,098 entitled "Refractory Lining For Metallurgical Vessel," which are expressly incorporated herein by reference, describe bottom linings for ladles that are pre-formed.

As best seen in FIG. 1, refractory well block 66 is dimensioned to be disposed in opening 59 of bottom lining 30. An upper nozzle 68 that is part of a slide gate assembly 72, shown in phantom, is inserted into well block 66.

The present invention shall now be described with respect to assembling bottom lining 30 into ladle 10. Bottom lining 30 may be fabricated, as described above, at a location remote from a place where ladle 10 is used to cast molten steel. It is also contemplated that bottom lining 30 may be fabricated at a mill. Whether bottom lining 30 is formed at a remote location or at a mill, bottom lining 30 is then placed within bottom 14 of ladle 10 using spaced-apart lifting assemblies 74. As shown in FIGS. 1 and 2, bottom lining 30 is dimensioned to form a slight gap 62 between refractory lining 22 of ladle 10 and the peripheral edge of bottom lining 30, as best seen in FIG. 1. Well block 66 is positioned within bottom lining 30 after bottom lining 30 is placed in ladle 10. Well block 66 is located in opening 59 below surface 58*a* of lowermost section 58 such that a recess 61 is formed in bottom lining 30. Gap 62 is filled with a conventionally known, refractory castable or ramming material 64 to complete the refractory lining covering bottom 14 of ladle 10. In this respect, castable or ramming material 64 also fills V-shaped slot 34 to aid in securing bottom lining 30 in ladle 10.

The present invention shall now be described with respect to a steel casting operation using ladle 10. Referring now to FIGS. 1-4, a ladle 10 having a bottom lining 30 illustrating a first embodiment of the present invention is shown. As described above, there is typically a carryover of slag from a metallurgical furnace into ladle 10. The slag typically forms a slag layer that floats on top of the molten metal in ladle 10. The molten metal in ladle 10 is cast from ladle 10 through well block 66 when slide gate assembly 72 is opened. As the molten metal in ladle 10 drains from ladle 10, the level of the molten metal decreases. As the level of the molten metal decreases, a point is reached wherein the level of the molten metal in ladle 10 is equal to the level of surface 42*a* of uppermost section 42. At this point, the slag layer floating on the molten metal engages surface 42*a* of uppermost section 42. As the level of the molten metal continues to decrease, the slag above surface 42*a* of uppermost section 42 has a tendency to adhere to surface 42*a* of uppermost section 42. In other words, a portion of the slag floating on the molten metal is retained on surface 42*a* of uppermost section 42 as the molten metal continues to drain from ladle 10.

As the level of the molten metal continues to decrease, a point is reached wherein the level of the molten metal in the ladle is equal to the elevation of surface 44*a* of intermediate section 44. As the level of the molten metal continues to decrease, the slag above surface 44*a* of intermediate section 44 begins to adhere, i.e., is retained, on surface 44*a* of intermediate section 44. In this respect, as molten metal continues to drain out of ladle 10, slag has a tendency to adhere and be retained on surfaces 46*a*, 48*a*, 52*a*, 54*a*, 56*a*, 58*a* in a similar manner as described above for surface 42*a* of uppermost section 42. In other words, as the molten metal is drained from ladle 10, the level of the molten metal in ladle 10 decreases such that slag is first retained on surface 42*a* of uppermost section 42, then slag is retained on surface 44*a* of intermediate section 44, then slag is retained on surface 46*a* of intermediate section 46, and so forth until slag is retained on surface 58*a* of lowermost section 58. Bottom lining 30 is designed such that as molten metal is drained from ladle 10, slag adheres to and is retained on successive stepped surfaces, namely surfaces 42*a*, 44*a*, 46*a*, 52*a*, 54*a*, 56*a*, 58*a*, as the level of the molten metal in ladle 10 decreases.

The casting of the molten metal from ladle 10 is preferably stopped before slag above well block 66 is entrained into the stream of molten metal exiting ladle 10. In this respect, the casting of molten metal from ladle 10 may be stopped when the level of the molten metal in ladle 10 is between surface 42*a* of uppermost section 42 and surface 58*a* of lowermost section 58.

The present invention therefore provides a stepped bottom lining that collects, i.e., retains, slag on an upper surface of the bottom lining, thereby reducing the amount of slag that may exit the ladle when the molten metal is drained from the ladle. The present invention also provides a stepped bottom lining that can improve yield by reducing the amount of residual molten metal remaining in a ladle at the end of a casting process.

Referring now to another aspect of the present invention, it is generally known that the draining of molten metal from ladle 10 may also cause a vortex, i.e., a swirling motion, to form in the molten steel above well block 66 once the level of molten metal in ladle 10 reaches a critical level. This vortex can cause the slag floating on the molten metal to be entrained into the molten metal exiting the ladle 10. In the northern hemisphere, when fluid drains from a tank, a vortex forms within the tank causing the fluid to rotate in a clockwise direction. Bottom lining 30 of the present invention is designed to facilitate flow of the molten metal in ladle 10 in a counter-clockwise direction to retard the formation of the vortex in ladle 10. In this respect, as molten metal is drained from ladle 10 and the level of the molten metal in ladle 10 decreases, successive sections 42, 44, 46, 48, 52, 54, 56, 58 of upper surface 36 are exposed. At one point the level of the molten metal in ladle 10 is between surface 42*a* of uppermost section 42 and surface 44*a* of intermediate section 44. As the level of the molten metal continues to decrease, molten metal above surface 44*a* of intermediate section 44 flows toward a surface at a lower elevation, i.e., surface 46*a* of intermediate section 46. In this respect, the molten metal above intermediate section 44 flows in a counter-clockwise direction towards intermediate section 46. This flow of molten metal, beneath the slag layer, is repeated for each successive section 46, 48, 52, 54, 56. The molten metal flows from successive sections 42, 44, 46, 48, 52, 54, 56 of upper surface 36 along a path "B-B" in a counter-clockwise direction. In this respect, bottom lining 30 is designed so that exposure of successive sections 42, 44, 46, 48, 52, 54, 56, 58 of upper surface 36, creates flow of molten metal in a counter-clockwise direction. It is believed that the flow of molten metal in the counter-clockwise direction, created by exposure of successive stepped sections 42, 44, 46, 48, 52, 54, 56, 58, retards the formation of the vortex in the molten metal in ladle 10 above well block 66. Retarding the formation of the vortex in the molten metal reduces the likelihood of slag floating on the molten metal being entrained into metal exiting through well block 66. The present invention, therefore, also provides a stepped bottom lining that retards the formation of a vortex in molten metal in a ladle by creating a flow opposite to the natural flow of the molten metal in the ladle. It is believed that this counter flow reduces the amount of slag that may exit the ladle when the molten metal is drained from ladle.

Figure 5:
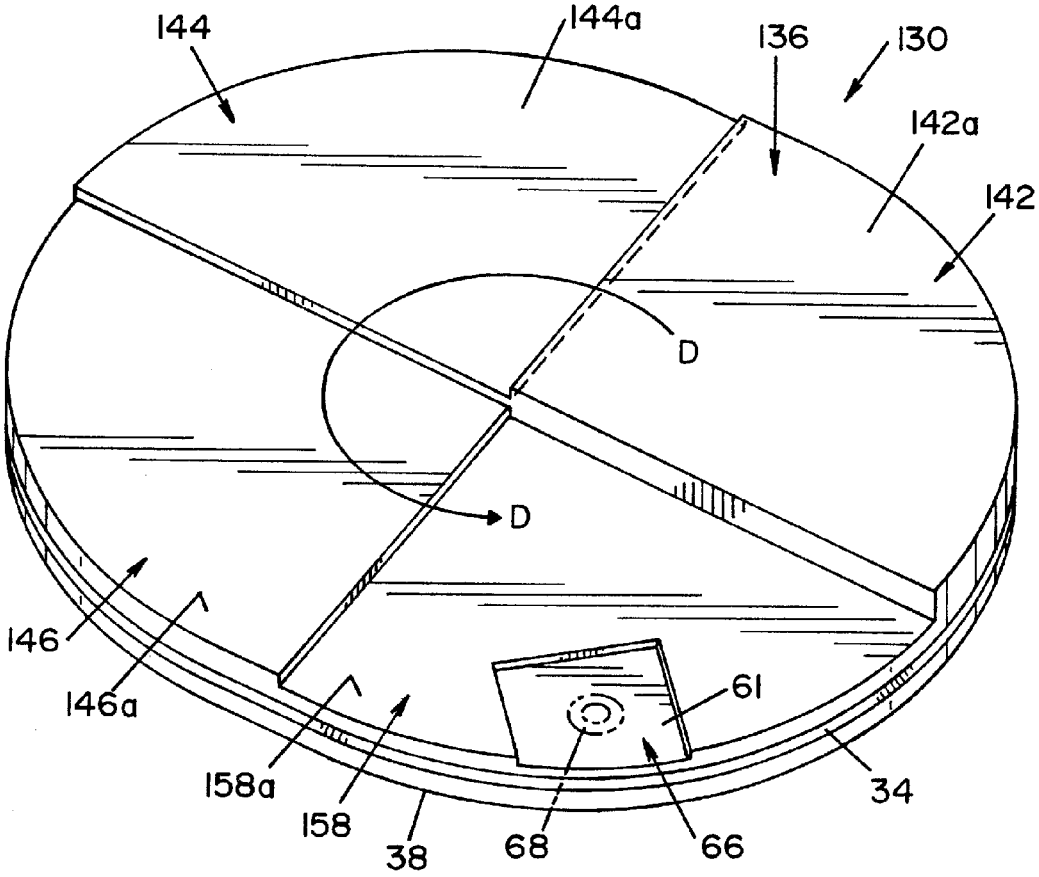
FIG. 5 is a perspective view of a bottom lining, illustrating a second embodiment of the present invention.

Referring now to FIG. 5, a bottom lining 130 illustrating a second embodiment of the present invention is shown. Elements of the second embodiment that are substantially the same as elements of the first embodiment, shown in FIGS. 1-4, have been given the same reference numbers and shall not be described in detail. Bottom lining 130 is similar in most respects to bottom lining 30. In one embodiment, bottom lining 130 is comprised of a castable refractory material. In an alternative embodiment (not shown), bottom lining 130 is comprised of refractory bricks or a combination of a castable refractory material and refractory bricks. Bottom lining 130 has an upper portion comprised of an uppermost section 142, two (2) intermediate sections 144, 146 and a lowermost section 158. In this respect bottom lining 130 has two (2) intermediate sections 144, 146 whereas bottom lining 30 has six (6) intermediate sections 44, 46, 48, 52, 54, 56. Uppermost section 142 has an upper surface 142*a*, intermediate section 144 has an upper surface 144*a*, intermediate section 146 has an upper surface 146*a* and lowermost section 158 has an upper surface 158*a*. In the embodiment shown, upper surfaces 142*a*, 144*a*, 146*a*, 158*a* are each parallel and horizontal when ladle 10 is in a normal operating orientation. An upper surface 136 is formed by combining surfaces 142*a*, 144*a*, 146*a*, 158*a*.

Well block 66 is placed in bottom lining 130 after bottom lining 130 is placed in ladle 10. Well block 66 is placed in bottom lining 130 below surface 158*a* of lowermost section 158 such that a recess 61 is formed therein, as best seen in FIG. 5.

The present invention shall now be described with respect to a steel casting operation using bottom lining 130 in ladle 10. The casting of steel using bottom lining 130 in ladle 10 is similar in most respects to casting steel using bottom lining 30 in ladle 10. In the second embodiment, the slag adheres to surfaces 142*a*, 144*a*, 146*a*, 158*a* instead of surfaces 42*a*, 44*a*, 46*a*, 48*a*, 52*a*, 54*a*, 56*a*, 58*a*, as described above for the first embodiment. In addition, as molten metal drains from ladle 10, the molten metal above upper surface 136 and beneath the slag layer flows from successive sections 142, 144, 146, 158 of upper surface 136 along a path "D-D" in a counter-clockwise direction. In this respect, bottom lining 130 is designed so that exposure of four (4) successive sections 142, 144, 146, 158 of upper surface 136, creates flow of molten metal in a counter-clockwise direction. The first embodiment, as described above, includes six (6) successive sections that are exposed to create flow of molten metal in a counter-clockwise direction.

Figure 6:
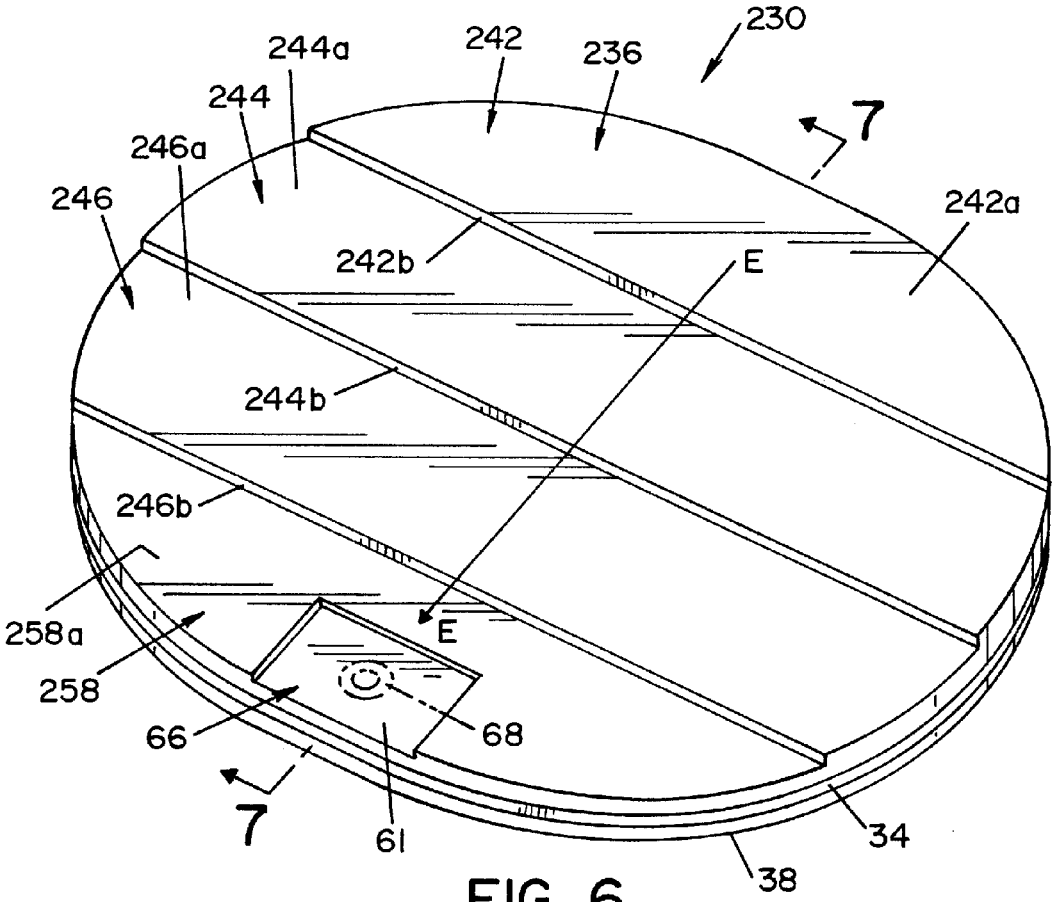
FIG. 6 is a perspective view of a bottom lining, illustrating a third embodiment of the present invention.
Figure 7:
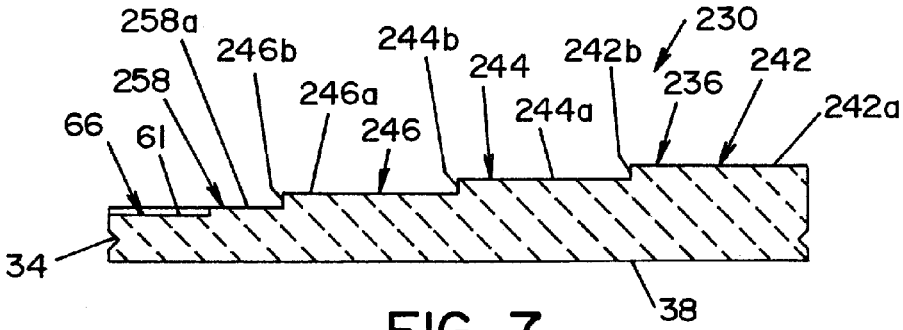
FIG. 7 is a sectional view taken along lines 7-7 of FIG. 6, showing a cross-section of the bottom lining.

Referring now to FIGS. 6-7, a bottom lining 230 illustrating a third embodiment of the present invention is shown. As best seen in FIG. 6, bottom lining 230 is generally oblong in shape and has an upper portion comprised of discrete sections. In the embodiment shown, the upper portion of bottom lining 230 is comprised of an uppermost section 242, two (2) intermediate sections 244, 246 and a lowermost section 258. Uppermost section 242, intermediate sections 244, 246 and lowermost section 258 are basically elongated sections that transverse the upper portion of bottom lining 230. Uppermost section 242 has an upper surface 242*a* and an edge 242*b*. Intermediate section 244 has an upper surface 244*a* and an edge 244*b*. Intermediate section 246 has an upper surface 246*a* and an edge 246*b*. Lowermost section 258 has an upper surface 258*a*. In the embodiment shown, edges 242*b*, 244*b*, 246*b* are parallel to each other. Surfaces 242*a*, 244*a*, 246*a*, 258*a* are each disposed at a discrete elevation and combine to form an upper surface 236. In the embodiment shown, surfaces 242*a*, 244*a*, 246*a*, 258*a* are each parallel and horizontal when ladle 10 is in a normal operating orientation. Surface 242*a* has an elevation higher than an elevation of surfaces 244*a*, 246*a*, 258*a*. Surfaces 244*a*, 246*a* are each dimensioned to have a different elevation such that surface 244*a* is higher than surface 246*a*. Surface 258*a* has an elevation lower than surface 246*a*. Surfaces 242*a*, 244*a*, 246*a*, 258*a* are arranged to form a series of successive steps, wherein each surface steps downwardly from surface 242*a*, to surfaces 244*a*, 246*a* to surface 258*a*.

Well block 66 is positioned within bottom lining 230 after bottom lining 230 is placed in ladle 10. Well block 66 is placed in bottom lining 230 below surface 258*a* of lowermost section 258 such that a recess 61 is formed therein, as best seen in FIG. 6.

The present invention shall now be described with respect to a steel casting operation using bottom lining 230 in ladle 10. As described above, a slag layer typically floats on top of the molten metal in ladle 10. As the molten metal in ladle 10 is cast from ladle 10, the level of the molten metal decreases and a portion of the slag floating on the molten metal adheres to and is retained on surface 242*a* of uppermost section 242. As molten metal continues to drain out of ladle 10, slag has a tendency to adhere to and be retained on surfaces 246*a*, 248*a*, 258*a*. In other words, as the molten metal is drained from ladle 10, the level of the molten metal in ladle 10 decreases such that slag is first retained on surface 242*a* of uppermost section 242, then slag is retained on surface 244*a* of intermediate section 244, then slag is retained on surface 246*a* of intermediate section 246 until slag is retained on surface 258*a* of lowermost section 258. Bottom lining 230 is designed such that as molten metal is drained from ladle 10, slag adheres to and is retained on successive stepped sections, namely uppermost section 242, intermediate sections 244, 246 and lowermost section 258, as the level of the molten metal in ladle 10 decreases.

Similar to the first embodiment, as the level of molten metal decreases, the molten metal above upper surface 236 and beneath the slag layer, flows from successive sections 242, 244, 246, 258 of upper surface 236 along a path "E-E." In this respect, bottom lining 230 is designed so that exposure of successive stepped sections 242, 244, 246, 258 causes molten metal to flow in a direction along the path "E-E."

Figure 8:
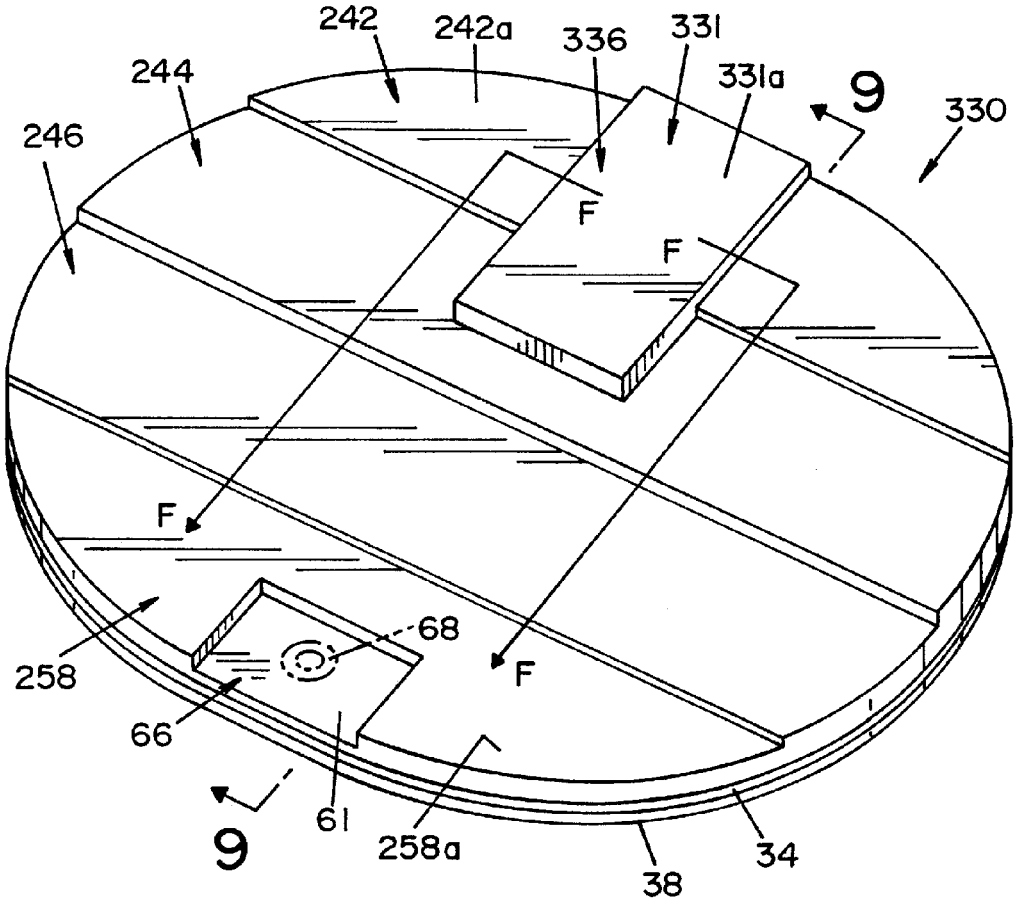
FIG. 8 is a perspective view of a bottom lining, illustrating a fourth embodiment of the present invention.
Figure 9:
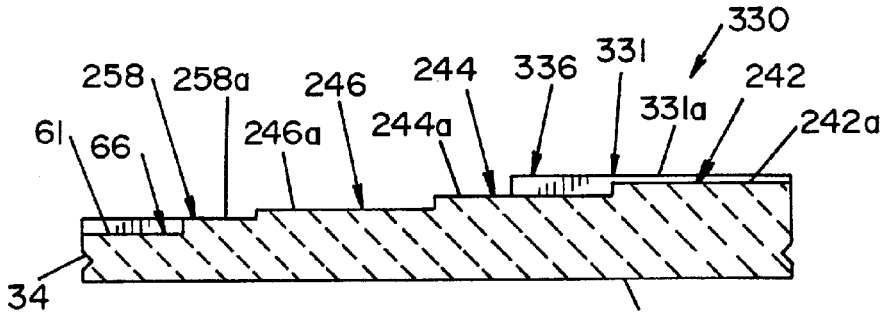
FIG. 9 is a sectional view taken along lines 9-9 of FIG. 8, showing a cross-section of the bottom lining.

Referring now to FIGS. 8-9, a bottom lining 330 illustrating a fourth embodiment of the present invention is shown. Elements of the forth embodiment that are substantially the same as elements of the third embodiment, shown in FIGS. 6-7, have been given the same reference numbers and shall not be described in detail. Bottom lining 330 is similar in most respects to bottom lining 230. Bottom lining 330 has an upper portion comprised of an uppermost section 242, two (2) intermediate sections 244, 246, a lowermost section 258 and an impact pad 331. In this respect bottom lining 330 includes impact pad 331 whereas bottom lining 230 does not include an impact pad. Impact pad 331 has an upper surface 331*a*. An upper surface 336 is formed by combining surfaces 242*a*, 244*a*, 246*a*, 258*a*, 331*a*.

In the embodiment shown, impact pad 331 is a rectangular member typically comprised of a cast, refractory material. In another embodiment (not shown), impact pad 331 is comprised of a plurality of tightly packed high-density and high-temperature refractory bricks or a combination of a cast, refractory material and refractory bricks. In the embodiment shown, impact pad 331 is embedded in bottom lining 330.

The casting of molten metal from ladle 10 containing bottom lining 330 is similar, in most respects, to casting molten metal from ladle 10 containing bottom lining 230. In the embodiment wherein bottom lining 330 is disposed in ladle 10, as molten metal is drained from ladle 10, the level of the molten metal decreases. As the level of the molten metal decreases, a point is reached wherein the level of the molten metal in ladle 10 is equal to the level of surface 331*a* of impact pad 331. At this point, the slag layer floating on the molten metal engages surface 331*a* of impact pad 331 such that the slag adheres to surface 331*a* of impact pad 331. As the level of the molten metal continues to decrease, slag adheres to successive sections 242, 244, 246, 258, as described above for bottom lining 230.

As the level of the molten metal in ladle 10 decreases, molten metal above surface 331*a* of impact pad 331 flows towards surface 242*a* of uppermost section 242 or towards surface 244*a* of intermediate section 244. As the molten metal continues to drain out of ladle 10, the molten metal above surface 336 flows to successive stepped sections 246, 258, as described above for bottom lining 230. The molten metal flows from successive stepped surfaces 331*a*, 242*a*, 244*a*, 246*a*, 258*a* of upper surface 336 along L-shape paths "F-F," In this respect, bottom lining 330 is designed so that exposure of successive surfaces 331*a*, 242*a*, 246*a*, 258*a*, creates flow of molten metal towards well block 66 along paths "F-F."

Figure 10:
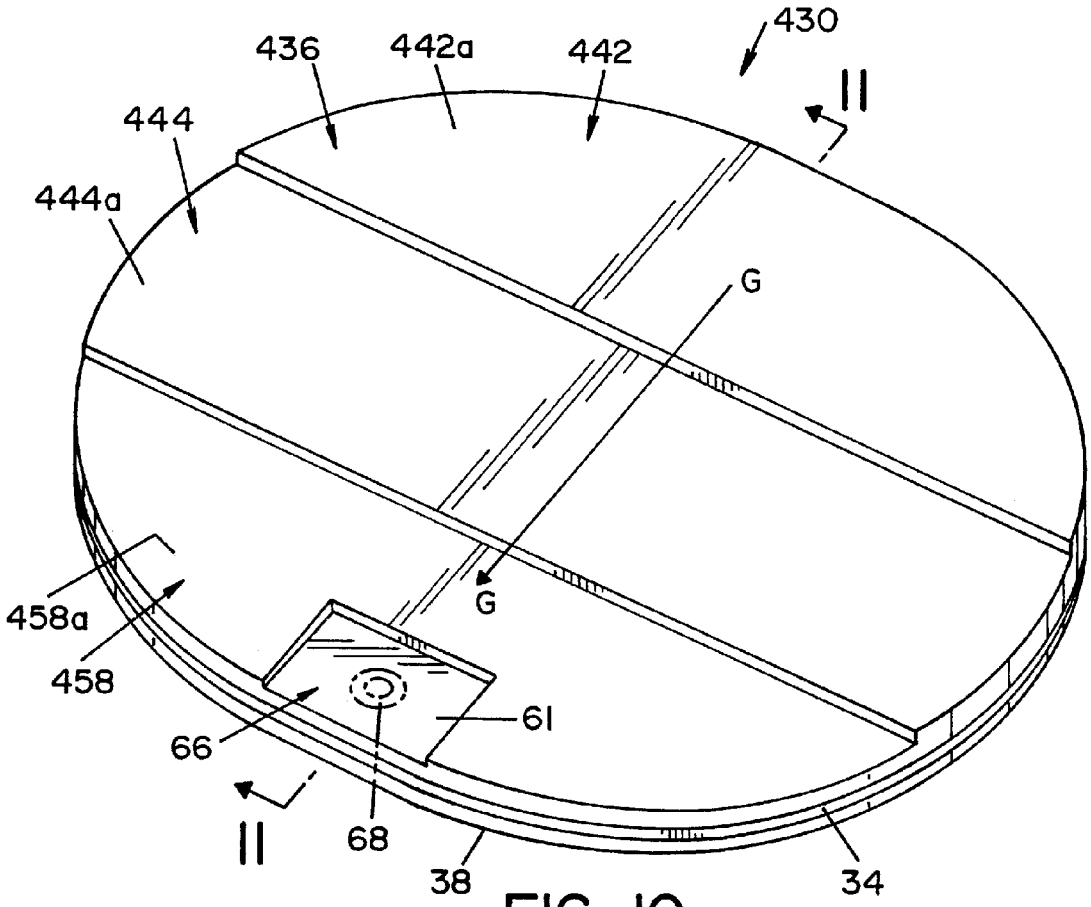
FIG. 10 is a perspective view of a bottom lining, illustrating a fifth embodiment of the present invention.
Figure 11:
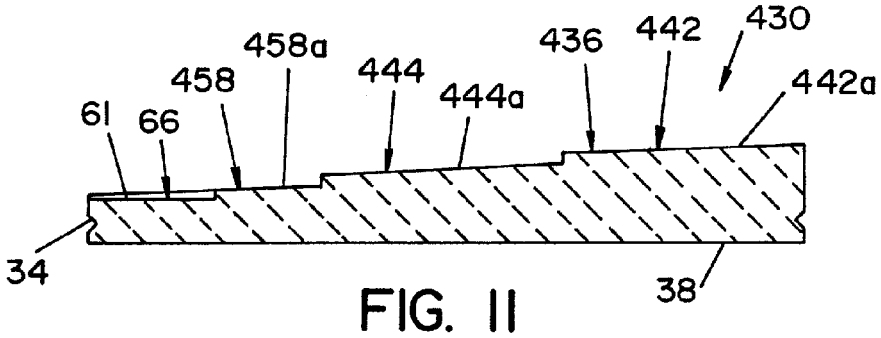
FIG. 11 is a sectional view taken along lines 11-11 of FIG. 10, showing a cross-section of the bottom lining.
Figure 12:
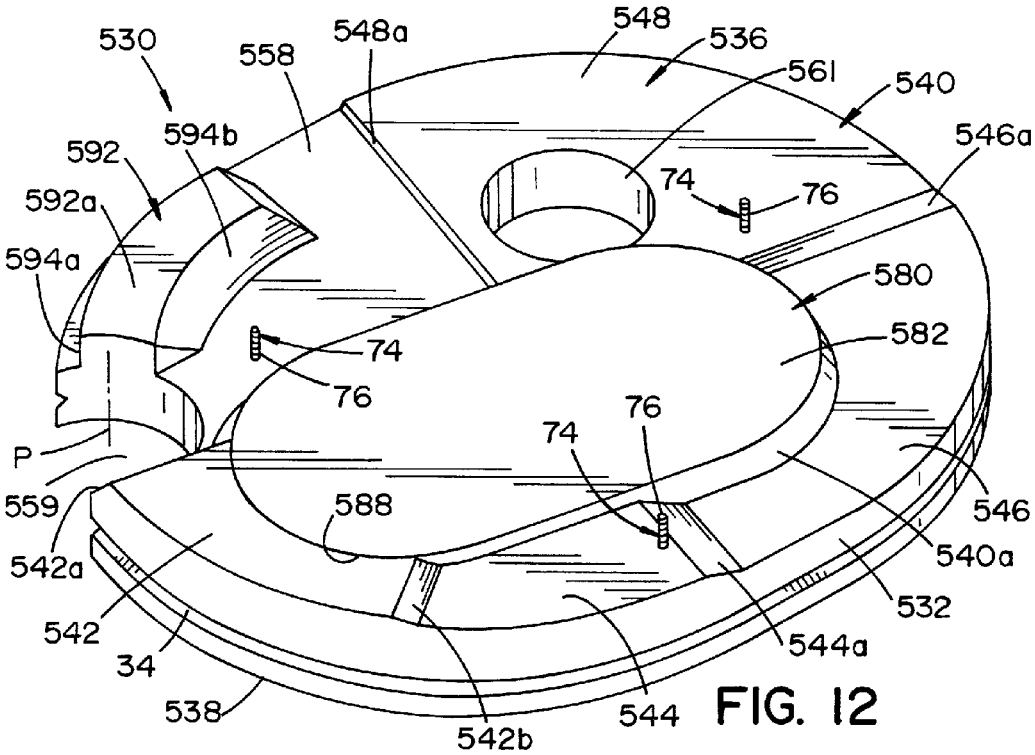
FIG. 12 is a perspective view of a bottom lining, illustrating a sixth embodiment of the present invention.

Referring now to FIGS. 10-11, a bottom lining 430 illustrating a fifth embodiment of the present invention is shown. Elements of the fifth embodiment that are substantially the same as elements of the third embodiment shown in FIGS. 6-7 have been given the same reference numbers and shall not be described in detail.

Bottom lining 430 has an upper portion comprised of an uppermost section 442, an intermediate section 444 and a lowermost section 458. In this respect, bottom lining 430 has one (1) intermediate section 444 whereas bottom lining 230 has two (2) intermediate sections 244, 246. Uppermost section 442 has an upper surface 442*a*, intermediate section 444 has an upper surface 444*a* and lowermost section 458 has an upper surface 458*a*. In the embodiment shown, surfaces 442*a*, 444*a*, 458*a* each generally slope downwardly towards well block 66, as best seen in FIG. 11, when ladle 10 is in a normal operating orientation. Surfaces 442*a*, 444*a*, 458*a* combine to form an upper surface 436. In this respect, bottom lining 430 has stepped surfaces 442*a*, 444*a*, 458*a* that each are sloped whereas bottom lining 230 has stepped surfaces 242*a*, 244*a*, 246*a*, 258*a* that each are horizontal.

The operation of casting steel from ladle 10 having bottom lining 430 is similar to casting steel from ladle 10 having bottom lining 230 and shall not be described in detail. Bottom lining 430 is designed to have an upper surface 436 such that the flow of molten metal along path "G-G" (as shown in FIG. 10), is aided by sloping surfaces 442*a*, 444*a*, 458*a* of upper surface 436 toward well block 66.

Referring now to FIGS. 12-15, a bottom lining 530, illustrating a sixth embodiment of the present invention is shown. Elements of the sixth embodiment that are substantially the same as elements of the first embodiment, shown in FIGS. 1-4, have been given the same reference numbers and shall not be described in detail.

Bottom lining 530 has a side surface 532, an upper surface 536 and a bottom surface 538. Side surface 532 is dimensioned to be spaced from side wall 16 of shell 12. Bottom surface 538 is dimensioned to overlay bottom 14 of metallic shell 12. In accordance with a preferred embodiment of the present invention, bottom lining 530 is formed of one or more refractory materials. Bottom lining 530 includes a stepped portion 540 and an impact portion 580.

Impact portion 580 of bottom lining 530 has an upper surface 582, a bottom surface 586 and a side surface 588. Impact portion 580 is formed of a refractory material. In the embodiment shown, impact portion 580 is formed of a cast refractory material.

Stepped portion 540 of bottom lining 530 is formed around impact portion 580 to embed or encase impact portion 580 therein. It is contemplated that stepped portion 540 and impact portion 580 may be formed of the same refractory material. In the embodiment shown, stepped portion 540 includes a sloped surface 540*a* that slopes downwardly from upper surface 582 of impact portion 580.

Stepped portion 540 is dimensioned such that an upper surface of stepped portion 540 is comprised of a plurality of discrete surface sections. In accordance with a preferred embodiment of the present invention, the upper surface of stepped portion 540 is designed to include an uppermost surface section 542, three (3) intermediate surface sections 544, 546, 548 and a lowermost surface section 558.

Uppermost surface section 542, intermediate surface sections 544, 546, 548 and lowermost surface section 558 are each disposed at a discrete elevation. In the embodiment shown, surface sections 542, 544, 546, 548, 558 are each parallel to each other and are horizontal when ladle 10 is in a normal operating orientation. Uppermost surface section 542 has an elevation higher than an elevation of surface sections 544, 546, 548, 558. Surface sections 544, 546, 548, 558 are each dimensioned to have a different elevation such that intermediate surface section 544 is higher than intermediate surface section 546, intermediate surface section 546 is higher than intermediate surface section 548, and intermediate surface section 548 is higher than lowermost surface section 558. In other words, each adjacent surface section from surface section 542 to surface section 558 is successively lower than the preceding surface section. Surface sections 542, 544, 546, 548, 558 are arranged to form a series of successive steps, wherein each surface section steps downwardly from uppermost surface section 542, to intermediate surface sections 544, 546, 548 to lowermost surface section 558.

In the embodiment shown, each surface section 542, 544, 546, 548 includes at least one transition surface to an adjacent lower surface section. A first transition surface 542*a* of uppermost surface section 542 extends between uppermost surface section 542 and lowermost surface section 558. A second transition surface 542*b* of uppermost surface section 542 extends between uppermost surface section 542 and intermediate surface section 544. A transition surface 544*a* of intermediate surface section 544 extends between intermediate surface section 544 and intermediate surface section 546. A transition surface 546*a* of intermediate surface section 546 extends between intermediate surface section 546 and intermediate surface section 548. A transition surface 548*a* of intermediate surface section 548 extends between intermediate surface section 548 and lowermost surface section 558. In the embodiment shown, transition surfaces 542*a*, 542*b*, 544*a*, 546*a*, 548*a* are sloped. It is contemplated that transition surfaces 542*a*, 542*b*, 544*a*, 546*a*, 548*a* may be substantially vertical.

A first opening 559 extends through stepped portion 540 at lowermost surface section 558. First opening 559 is dimensioned to receive refractory well block 66, described in detail above. First opening 559 has a central axis "P" extending therethrough. In the embodiment shown, first opening 559 is circular in shape. A second opening 561 extends through stepped portion 540 at intermediate surface section 548. In the embodiment shown, the surfaces of stepped portion 540 that define first opening 559 and second opening 561 include a locking feature (not shown) for securing a structure, e.g., a well block, therein. The foregoing locking feature is described in detail in U.S. patent application Ser. No. 12/022,417, expressly incorporated herein by reference.

A raised curb 592 extends upwardly from lowermost surface section 558. Raised curb 592 extends from first opening 559 to a location on lowermost surface section 558 that is spaced from transition surface 548*a* of intermediate surface section 548. Raised curb 592 has an upper surface 592*a*, a first side 594*a* and a second side 594*b*. Upper surface 592*a* preferably has an elevation less than the elevation of uppermost surface section 542. In the embodiment shown, upper surface 592*a* has an elevation equal to the elevation of intermediate surface section 544.

Figure 13:
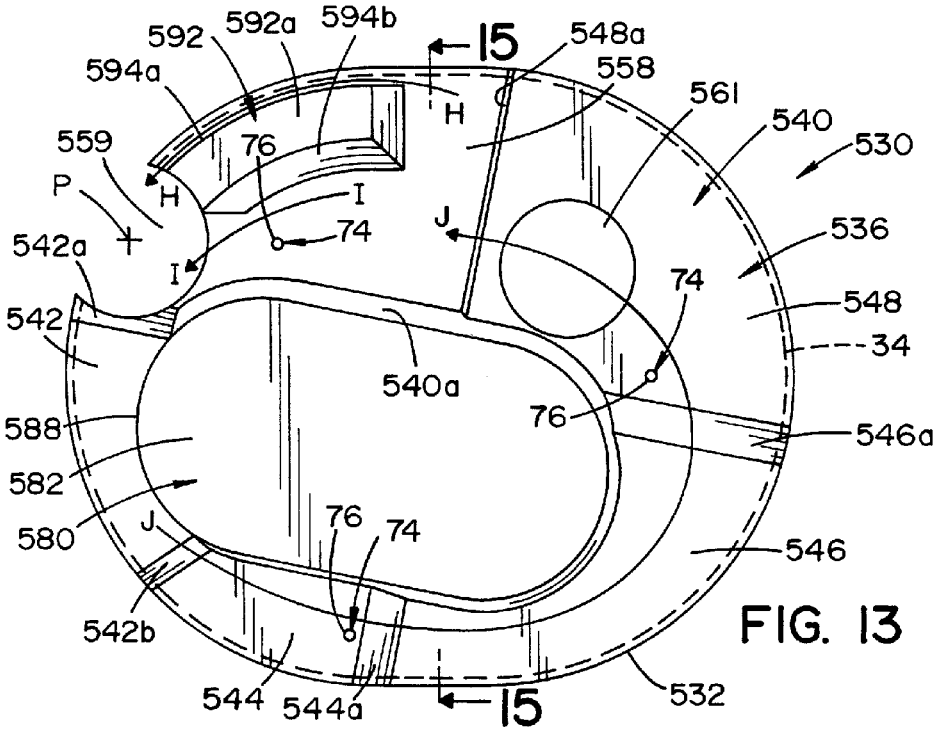
FIG. 13 is a top plan view of the bottom lining shown in FIG. 12.
Figure 14:
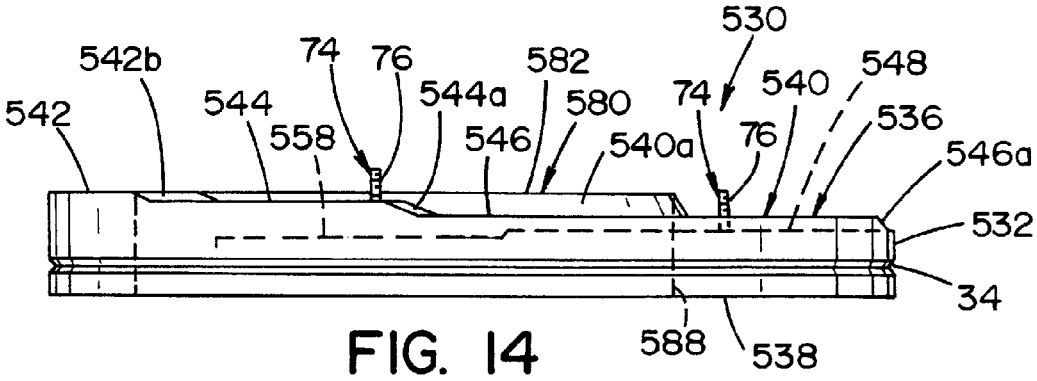
FIG. 14 is a side elevation view of the bottom lining shown in FIG. 12.
Figure 15:
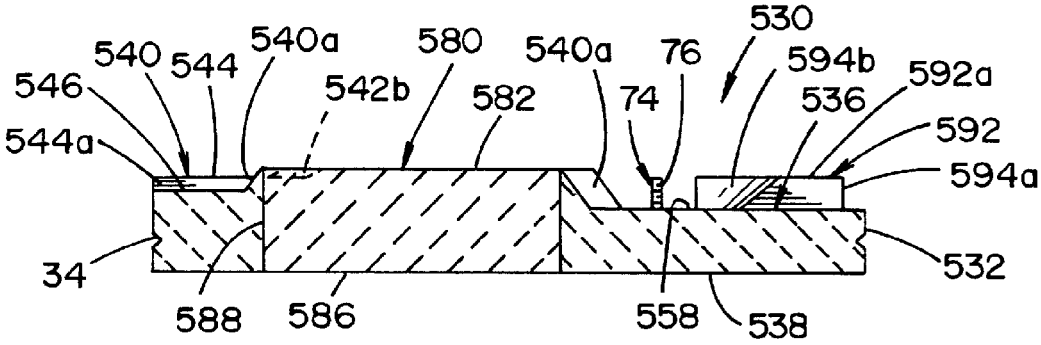
FIG. 15 is a sectional view taken along lines 15-15 of FIG. 13, showing a cross-section of the bottom lining.

As best seen in FIG. 13, first side 594*a* of raised curb 592 is spaced from side surface 532 of bottom lining 530 to define a first flow path "H-H" therebetween. Second side 594*b* of raised curb 592 is spaced from impact portion 580 of bottom lining 530. In the embodiment shown, second side 594*b* is spaced from sloped surface 540*a* to define a second flow path "I-I" therebetween. First flow path "H-H" and second flow path "I-I" are described in detail below. In the embodiment shown, second side 594*b* of raised curb 592 is sloped. It is contemplated that second side 594*b* may be substantially vertical.

The present invention shall now be described with respect to a metal casting operation using bottom lining 530 in ladle 10. In preparation for the casting operation, ladle 10 is filled with molten metal from a metallurgical furnace. As the molten metal is poured into ladle 10, the molten metal impacts upper surface 536 of bottom lining 530. Due to the force of the molten metal impacting bottom lining 530 and the corrosive properties of the molten metal, upper surface 536 of bottom lining 530 tends to wear quickly. According to the present invention, bottom lining 530 includes an impact portion 580 formed of a refractory material that is specially designed to be resistant to the wearing caused by the impact and the corrosive properties of the molten metal. As such, when the molten metal is poured from the metallurgical furnace, the molten metal is directed or aimed at impact portion 580 to prolong the useful life of bottom lining 530.

After ladle 10 is filled with a predetermined amount of molten metal, the casting of molten metal using bottom lining 530 in ladle 10 is similar in most respects to casting molten metal using bottom lining 30 in ladle 10. In the sixth embodiment, the slag adheres to surface sections 542, 544, 546, 548, 558. In addition, as molten metal drains from ladle 10, the molten metal above upper surface 536 and beneath the slag layer flows from successive surface sections 542, 544, 546, 548 of stepped portion 540 along a path "J-J" in a counterclockwise direction.

Raised curb 592 causes the molten metal above lowermost section 558 and beneath the slag layer to separate and flow along first flow path "H-H" and second flow path "I-I." According to the present invention, raised curb 592 is dimensioned and positioned such that first flow path "H-H" causes the molten metal to flow in a first direction toward first opening 559 and second flow path "I-I" causes the molten metal to flow in a second direction toward first opening 559.

In accordance with the embodiment of the present invention shown in FIGS. 12-15, first side 594*a* of raised curb 592 is positioned and dimensioned such that molten metal flowing along first flow path "H-H" flows toward opening 559 in a direction that is generally counterclockwise relative to central axis "P" of opening 559. Moreover, second side 594*b* of raised curb 592 is position and dimensioned such that molten metal flowing along second flow path "I-I" flows toward opening 559 in a direction that is generally clockwise relative to central axis "P" of opening 559. In this respect, bottom lining 530 of the present invention is designed such that the flow of molten metal along first flow path "H-H" counters or interferes with the flow of molten metal along second flow path "I-I." It is believed that creating flow along first flow path "H-H" in a direction that is counter to the direction of flow along second flow path "I-I" will hinder or retard the formation of a vortex at first opening 559.

In accordance with the embodiment of the present invention shown in FIGS. 12-15, first side 594*a* of raised curb 592 is positioned and dimensioned such that the distance between first side 594*a* and side surface 532 is constant in the direction toward opening 559. By maintaining the distance between first side 594*a* and side surface 532 constant in the direction toward opening 559, it is believed that the speed of the molten metal flowing along first flow path "H-H" will remain constant in the direction toward opening 559. In addition, second side 594*b* of raised curb 592 is positioned and dimensioned relative to impact portion 580 such that the distance between second side 594*b* and impact portion 580 decreases in the direction toward opening 559. By decreasing the distance between second side 594*b* and impact portion 580 in the direction toward opening 559, it is believed that the speed of the molten metal flowing along second flow path "I-I" will increase in the direction toward opening 559. It is believed that first side 594*a* and second side 594*b* of raised curb 592 may be positioned and dimensioned to control the speed that molten metal flows along first flow path "H-H" relative to the speed that molten metal flows along second flow path "I-I". For example, first side 594*a* and second side 594*b* may be positioned and dimensioned such that the flow rate of molten metal along first flow path "H-H" is equal to, less than or greater than the flow rate of molten metal along second flow path "I-I." It is believed that first side 594*a* and second side 594*b* of raised curb 592 may be positioned and dimensioned such that the molten metal flowing along first flow path "H-H" and the molten metal flowing along second flow path "I-I" will hinder or retard the formation of a vortex at opening 559.

In summary, bottom lining 530 is designed so that the exposure of four (4) successive sections 542, 544, 546, 548 of stepped portion 540 creates flow of molten metal in a counterclockwise direction. Moreover, bottom lining 530 is designed such that raised curb 592 divides the molten metal above lowermost surface section 558 into first flow path "H-H" and second flow path "I-I" to aid in hindering or retarding the formation of a vortex at first opening 559.

Referring now to FIGS. 16-19, a bottom lining 630 illustrating a seventh embodiment of the present invention is shown. Elements of the seventh embodiment that are substantially the same as elements of the first embodiment, shown in FIGS. 1-4, have been given the same reference numbers and shall not be described in detail.

Bottom lining 630 has a bottom surface 638, a side surface 632 and an upper surface 636. Bottom surface 638 is dimensioned to overlay bottom 14 of metallic shell 12. In accordance with a preferred embodiment of the present invention, bottom lining 630 is formed of one or more refractory materials.

Figure 16:
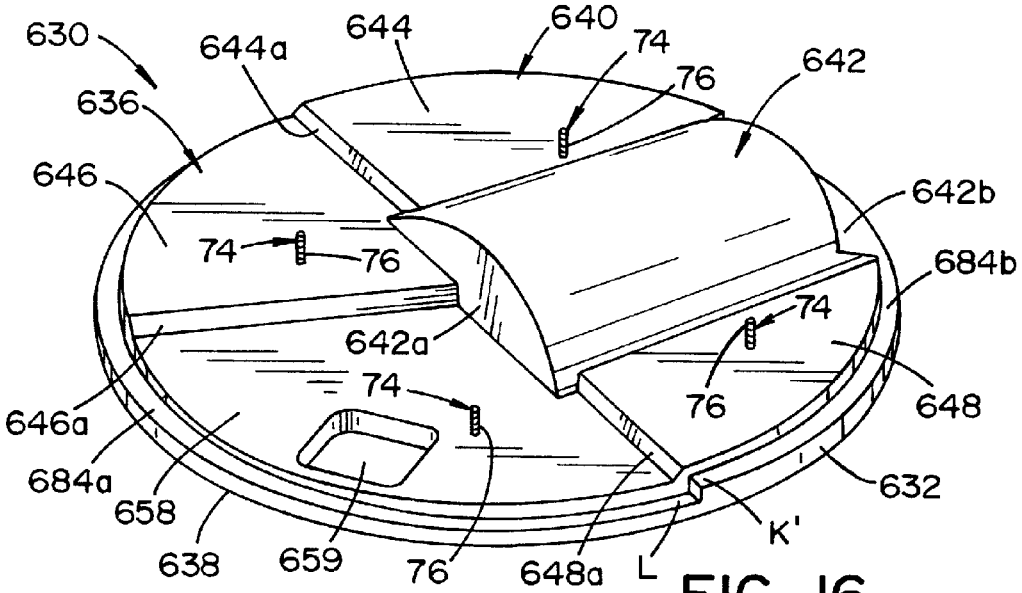
FIG. 16 is a perspective view of a bottom lining, illustrating a seventh embodiment of the present invention.
Figure 18:
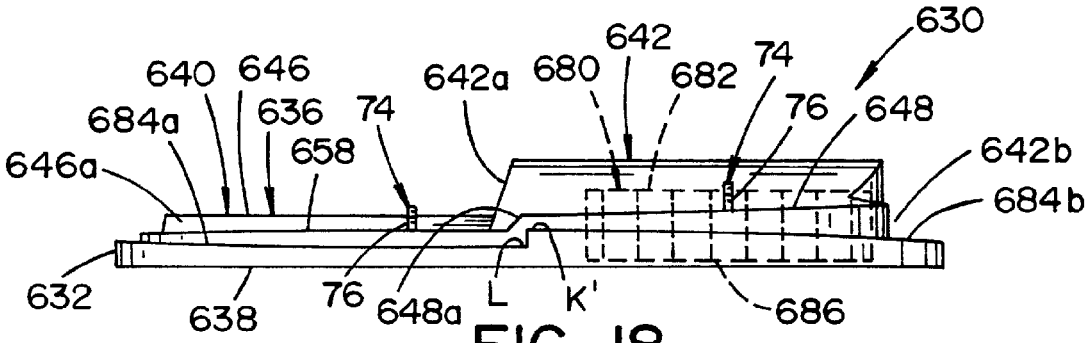
FIG. 18 is a side elevation view of the bottom lining shown in FIG. 16.
Figure 19:
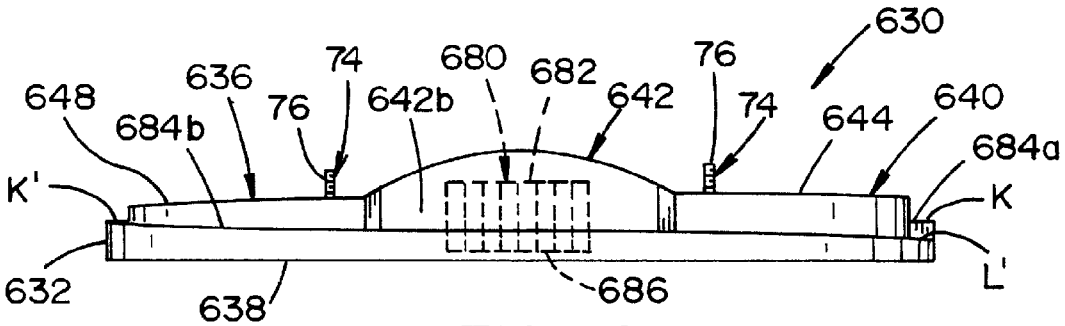
FIG. 19 is a rear elevation view of the bottom lining shown in FIG. 16.

Side surface 632 of bottom lining 630 is formed to define a flange that extends outwardly from a periphery of bottom lining 630. The flange includes two (2) sloped sections 684*a*, 684*b* that extend around side surface 632, as best seen in FIGS. 16, 18 and 19. First sloped section 684*a* has a maximum height at a point K and a minimum height at point L. In accordance with one embodiment of the present invention, first sloped section 684*a* slopes downwardly from point K to point L at a slope of between about 0.1 to about 0.3 inches per linear foot, preferably about 0.17 inches per linear foot.

Second sloped section 684*b* has a maximum height at point K' and a minimum height at point L'. In accordance with a preferred embodiment of the present invention, second sloped section 684*b* slopes downwardly from point K' to point L' at a slope of between about 0.1 to about 0.3 inches per linear foot, preferably about 0.17 inches per linear foot.

Bottom lining 630 includes a stepped portion 640 and an impact portion 680. Impact portion 680 of bottom lining 630 has an upper surface 682 and a bottom surface 686. Impact portion 680 is formed of a refractory material. In the embodiment shown, impact portion 680 is formed of a plurality of refractory bricks that are embedded within bottom lining 630. In the embodiment shown, impact portion 680 is embedded within bottom lining 630 between bottom surface 638 and upper surface 636 of bottom lining 630. It is contemplated that stepped portion 640 and impact portion 680 may be formed of the same refractory material.

Stepped portion 640 of bottom lining 630 is formed around impact portion 680 to embed or encase impact portion 680 therein. Stepped portion 640 of bottom lining 630 is dimensioned to have an upper surface that is comprised of a plurality of discrete surface sections. In the embodiment shown, the upper surface of stepped portion 640 is designed to include an uppermost surface section 642, three (3) intermediate surface sections 644, 646, 648 and a lowermost surface section 658.

Uppermost surface section 642 borders intermediate surface sections 644, 646, 648 and lowermost surface section 658. In the embodiment shown, uppermost surface section 642 is crowned to direct molten metal thereon into two (2) opposing directions. In accordance with a preferred embodiment of the present invention, uppermost surface section 642 is a cylindrical surface with a central axis parallel to bottom surface 638 of bottom lining 630. It is contemplated that uppermost surface section 642 may be peaked or triangular in shape to direct molten metal into two (2) opposing directions.

Figure 17:
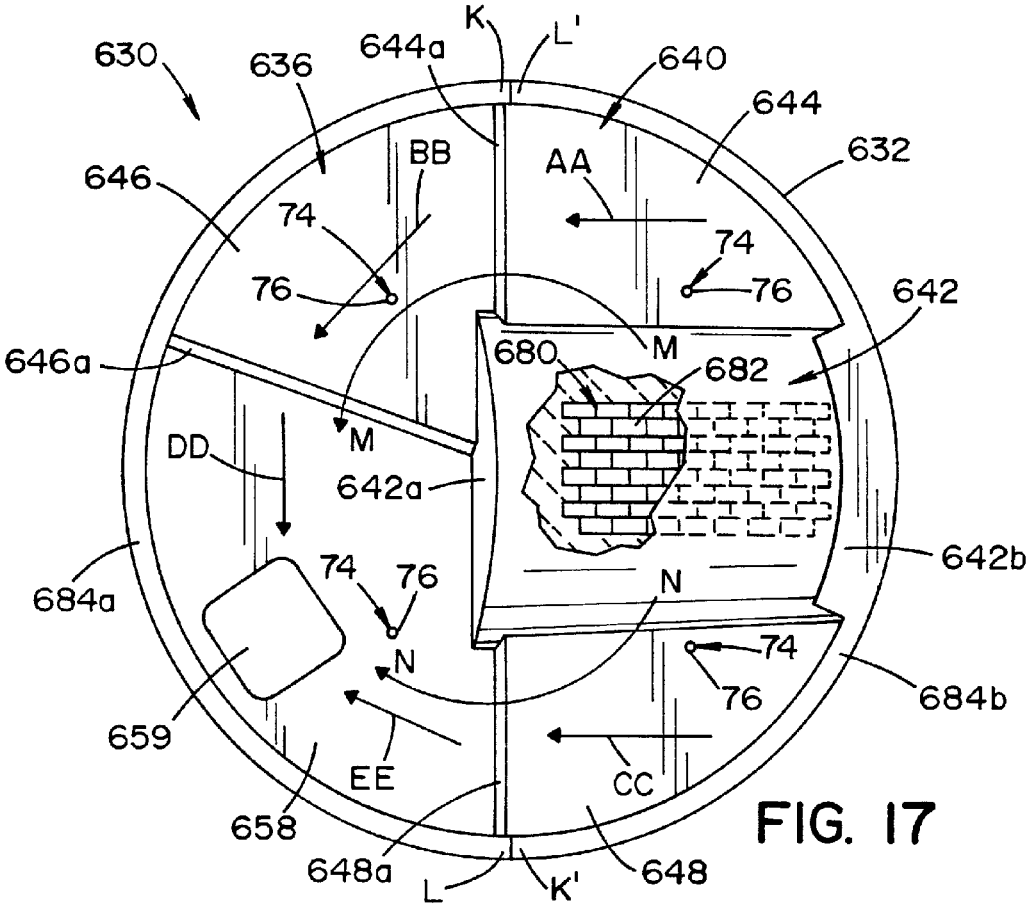
FIG. 17 is a top plan view of the bottom lining shown in FIG. 16.

As best seen in FIGS. 16 and 17, a notch 642*b* is formed in stepped portion 640 at an end of uppermost surface section 642. In the embodiment shown, impact portion 680 is embedded within bottom lining 630 below uppermost surface section 642.

Intermediate surface sections 644, 646, 648 and lowermost surface section 658 are each disposed at a discrete elevation. In the embodiment shown, surface sections 644, 646, 648, 658 are sloped toward opening 659 when ladle 10 is in a normal operating orientation. FIG. 17 includes arrows that indicate the general direction that surface sections 644, 646, 648, 658 are sloped. According to a preferred embodiment of the present invention, surface section 644 slopes downwardly at a slope of about 0.1 inches per linear foot along line "AA." Surface section 646 slopes downwardly at a slope of about 0.2 inches per linear foot along line "BB." Surface section 648 slopes downwardly at a slope of about 0.4 inches per linear foot along line "CC." Surface section 658 slopes downwardly at a slope of about 0.05 inches per linear foot along lines "DD" and "EE."

Surface sections 644, 646, 658 are each dimensioned to have a different elevation such that surface section 644 is higher than surface section 646 and surface section 646 is higher than surface section 658. In other words, each adjacent surface section from surface section 644 to surface section 658 is successively lower than the preceding surface section. Surface sections 642, 644, 646, 658 are arranged to form a first series of successive steps, wherein each surface section steps downwardly from uppermost surface section 642, to surface sections 644, 646, 658.

Surface sections 648, 658 are each dimensioned to have a different elevation such that surface section 648 is higher than surface section 658. Surface sections 642, 648, 658 are arranged to form a second series of successive steps, wherein each surface section steps downwardly from surface section 642, to surface sections 648, 658.

In the embodiment shown, each surface section 642, 644, 646, 648 includes a transition surface to an adjacent lower surface section. A transition surface 642*a* of uppermost surface section 642 extends between uppermost surface section 642 and intermediate surface section 646 and lowermost surface section 658. A transition surface 644*a* of intermediate surface section 644 extends between intermediate surface section 644 and intermediate surface section 646. A transition surface 646*a* of intermediate surface section 646 extends between intermediate surface section 646 and lowermost surface section 658. A transition surface 648*a* of intermediate surface section 648 extends between intermediate surface section 648 and lowermost surface section 658. In the embodiment shown, transition surfaces 642*a*, 644*a*, 646*a*, 648*a* are sloped. It is contemplated that transition surfaces 642*a*, 644*a*, 646*a*, 648*a* may be substantially vertical.

An opening 659 extends through stepped portion 640 at lowermost section 658. Opening 659 is dimensioned to receive refractory well block 66, described in detail above. In the embodiment shown, opening 659 is rectangular in shape.

The present invention shall now be described with respect to a molten metal casting operation using bottom lining 630 in ladle 10. As described above, in preparation for the casting operation, ladle 10 is filled with molten metal from a metallurgical furnace. According to the present invention, bottom lining 630 includes impact portion 680 that is disposed below uppermost surface section 642 of bottom lining 630. In this respect, as the molten metal from the metallurgical furnace is poured into ladle 10, the molten metal is directed or aimed at impact portion 680 of bottom lining 630. As described in detail above, uppermost surface section 642 is crowned. As such, as molten metal is poured into ladle 10, the molten metal impacts uppermost surface section 642 and uppermost surface section 642 redirects the molten metal into two (2) opposing directions.

After ladle 10 is filled with a predetermined amount of molten metal, the casting of molten metal using bottom lining 630 in ladle 10 is similar in most respects to casting molten metal using bottom lining 30 in ladle 10. In the seventh embodiment, the slag adheres to surface sections 644, 646, 648, 658. In addition, as molten metal drains from ladle 10, uppermost surface section 642 causes a portion of the molten metal thereabove to flow above toward intermediate surface section 644 and a portion of the molten metal thereabove to flow toward intermediate surface section 648. The molten metal above intermediate surface section 644 then flows along successive surface sections 646, 658. In this respect, the first series of successive surface sections 642, 644, 646, 658 define a first flow path "M-M." The molten metal above intermediate surface section 648 then flows along successive surface section 658. In this respect, the second series of successive surface sections 642, 648, 658 define a second flow path "N-N."

According to the present invention, the first and second series of successive surface sections are dimensioned and positioned such that first flow path "M-M" causes the molten metal to flow in a first direction toward opening 659 and second flow path "N-N" causes the molten metal to flow in a second, opposite direction toward opening 659. In particular, the flow of molten metal along first flow path "M-M" is designed to counter or interfere with the flow of molten metal along second flow path "N-N". It is believed that creating flow along first flow path "M-M" in a direction that is counter to the direction of flow along second flow path "N-N" will reduce the likelihood of a vortex developing at opening 659. According to the embodiment of the present invention shown in FIGS. 16-19, bottom lining 630 is designed so that the exposure of surface sections 642, 644, 646, 658 creates flow of molten metal in a counter-clockwise direction whereas the exposure of surface sections 642, 648, 658 creates flow of molten metal in a clockwise direction. It is believed that creating flow along first flow path "M-M" in a direction that is counter to the direction of flow along second flow path "N-N" will hinder or retard the formation of a vortex at first opening 659.

In accordance with the present invention, surface sections 644, 646, 648, 658 are sloped toward opening 659. It is believed that sloping surface sections 644, 646, 648, 658 at a predetermined slope results in molten metal flow along first flow path "M-M" and along second flow path "N-N" that hinders or retards the formation of a vortex at opening 659.

It should be understood that a bottom lining, according to the present invention, may assume other shapes and configurations without deviating from the present invention. For example, bottom linings, 30, 130, 230, 330, 430, 530, 630 each show sections of upper surfaces 36, 136, 236, 336, 436, 536, 636 that are generally planar. It is also contemplated that upper surfaces 36, 136, 236, 336, 436, 536, 636 may have sections that are non-planar, e.g., convex-shaped or concave-shaped to facilitate a desired flow of metal within ladle 10. Furthermore, in an alternative embodiment of the present invention all or at least a portion of the refractory cast material of bottom lining 30, 130, 230, 330, 430, 530, 630 may be substituted with refractory bricks. It should be further appreciated that each embodiment of the bottom lining described above may be modified to incorporate one or more features of the other embodiments. For example, FIGS. 1-9 and 12-15 show sections of upper surfaces 36, 136, 236, 336, 536 that are horizontal. It is contemplated that sections of upper surfaces 36, 136, 236, 336, 536 may also be sloped, similar to sections 442, 444, 458 of upper surface 436, as shown in FIGS. 10-11 and surface sections 644, 646, 648, 658 of upper surface 636, as shown in FIGS. 16-19.

Other modifications and alterations will occur to others upon their reading and understanding of the specification. It is intended that all such modifications and alterations be included insofar as they come within the scope of the invention as claimed or the equivalents thereof.

Having described the invention, the following is claimed:

1. A refractory bottom lining for a metallurgical vessel, said metallurgical vessel having a bottom and a side wall, said bottom lining having:

a bottom surface that is dimensioned to overlay said bottom of said metallurgical vessel;

an outer peripheral edge dimensioned to be spaced from said side wall of said metallurgical vessel;

an impact portion formed of a first refractory material, said impact portion having an upper surface and an outer peripheral edge;

a stepped portion formed of a second refractory material, said stepped portion disposed around said outer peripheral edge of said impact portion, said stepped portion having:

an upper surface comprising a plurality of discrete surface sections including an uppermost surface section, at least two intermediate surface sections and a lowermost surface section, said uppermost surface section, said at least two intermediate surface sections and said lowermost surface section disposed around a periphery of said impact portion such that said upper surface of said impact portion is spaced from said outer peripheral edge of said bottom lining, each surface section of said upper surface being disposed at a different elevation wherein said uppermost surface section has a highest elevation, said lowermost surface section has a lowest elevation, and said at least two intermediate surface sections each have an intermediate elevation that is different from each other and are disposed between said highest elevation and said lowest elevation, all of said discrete surface sections forming said upper surface of said stepped portion being arranged in elevation-descending order from said uppermost surface section to said lowermost surface section to define a continuously downward stepped path from said uppermost surface section to said lowermost surface section, wherein each successive surface section along said continuously downward stepped path is lower than a preceding surface section in said continuously downward stepped path; and an opening extending through said lowermost surface section of said stepped portion to allow a molten metal to drain from said metallurgical vessel.

2. A refractory bottom lining according to claim 1, wherein said continuously downward stepped path is circular in a counter-clockwise direction.

3. A refractory bottom lining according to claim 1, wherein said uppermost surface section of said stepped portion and said upper surface of said impact portion have the same elevation.

4. A refractory bottom lining according to claim 1, wherein a raised curb is disposed on said lowermost surface section, said raised curb extending from said opening to a location on said lowermost surface section, said location spaced from an adjacent intermediate surface section.

5. A refractory bottom lining according to claim 4, wherein one side of said raised curb is spaced from said outer peripheral edge of said bottom lining and another side of said raised curb is spaced from said impact portion.

6. A refractory bottom lining according to claim 1, wherein said opening in said lowermost surface section is disposed adjacent to said uppermost surface section.

7. A refractory bottom lining according to claim 1, wherein said bottom lining is comprised of a refractory castable.

8. A refractory bottom lining according to claim 1, wherein said bottom lining is comprised of refractory bricks.

9. A refractory bottom lining according to claim 1, wherein said bottom lining is comprised of a combination of a refractory castable and refractory bricks.

10. A refractory bottom lining for lining a bottom of a metallurgical vessel having a side wall, said bottom lining being a three-dimensional structure formed of a refractory material and having:

a bottom surface that is dimensioned to overlay said bottom of said metallurgical vessel;

an outer peripheral edge dimensioned to be spaced from said side wall of said metallurgical vessel;

a stepped portion formed of a first refractory material, said stepped portion having:

an upper surface comprising a plurality of discrete surface sections including an uppermost surface section, at least two intermediate surface sections and a lowermost surface section, each surface section of said upper surface being disposed at a different elevation wherein said uppermost surface section has a highest elevation, said lowermost surface section has a lowest elevation, and said intermediate surface sections each have an intermediate elevation that is different from each other and disposed between said highest elevation and said lowest elevation, all of said discrete surface sections forming said upper surface of said stepped portion being arranged in elevation-descending order from said uppermost surface section to said lowermost surface section to define a continuously downward stepped path from said uppermost surface section to said lowermost surface section, wherein each successive surface section along said continuously downward stepped path is lower than a preceding surface section in said continuously downward stepped path;

an opening extending through said lowermost surface section of said stepped portion to allow a molten metal to drain from said metallurgical vessel; and a raised curb disposed on said lowermost surface section of said stepped portion, said raised curb extending from said opening to a location on said lowermost surface section, said location spaced from an adjacent intermediate surface section, said raised curb having a first side spaced from said outer peripheral edge of said bottom lining and a second side spaced from said impact portion.

11. A refractory bottom lining according to claim 10, further having an impact portion formed of a second refractory material, said impact portion embedded within a central portion of said bottom lining such that said upper surface of said stepped portion of said bottom lining is disposed around an outer peripheral edge of said impact portion.

12. A refractory bottom lining according to claim 11, wherein said impact portion has an upper surface, said upper surface of said impact portion and said uppermost surface section of said stepped portion having the same elevation.

13. A refractory bottom lining according to claim 10, wherein said opening in said lowermost surface section is disposed adjacent to said uppermost surface section.

14. A refractory bottom lining according to claim 10, wherein said bottom lining is comprised of a refractory castable.

15. A refractory bottom lining according to claim 10, wherein said bottom lining is comprised of refractory bricks.

16. A refractory bottom lining according to claim 10, wherein said bottom lining is comprised of a combination of a refractory castable and refractory bricks.

17. A refractory bottom lining for lining a bottom of a metallurgical vessel, said bottom lining being a three-dimensional structure formed of a refractory material and having:

a bottom surface that is dimensioned to overlay said bottom of said metallurgical vessel;

a stepped portion formed of a first refractory material, said stepped portion having an upper surface comprised of an uppermost surface section, at least two intermediate surface sections and a lowermost surface section, said surface sections of said upper surface being arranged in elevation-descending order from said uppermost surface section to said lowermost surface section to define two continuously downward stepped paths from said uppermost surface section to said lowermost surface section, wherein each successive surface section along each of said two continuously downward stepped paths is lower than a preceding surface section in said continuously downward stepped path and wherein said surface sections are disposed such that a first of said two continuously downward stepped paths is arcuate in a counterclockwise direction about a first vertical axis extending through a central portion of said bottom lining and a second of said two continuously downward stepped paths is arcuate in a clockwise direction about a second vertical axis extending through a central portion of said bottom lining; and an opening extending through said lowermost surface section of said stepped portion to allow a molten metal to drain from said metallurgical vessel.

18. A refractory bottom lining according to claim 17, further comprising:

an impact portion formed of a second refractory material, said impact portion embedded within said stepped portion of said bottom lining.

19. A refractory bottom lining according to claim 17, wherein said uppermost surface section is curved.

20. A refractory bottom lining according to claim 17, wherein said at least two intermediate surface sections and said lowermost surface section are sloped toward said opening in said bottom lining.

21. A refractory structure according to claim 17, wherein said bottom lining is comprised of a refractory castable.

22. A refractory bottom lining according to claim 17, wherein said bottom lining is comprised of refractory bricks.

23. A refractory bottom lining according to claim 17, wherein said bottom lining is comprised of a combination of a refractory castable and refractory bricks.

24. A refractory bottom lining according to claim 17, wherein one of said two continuously downward stepped paths includes at least two intermediate surface sections.

25. A refractory bottom lining according to claim 17, wherein one of said two continuously downward stepped paths includes only one intermediate surface section.

26. A refractory bottom lining according to claim 17, wherein the first vertical axis and the second vertical axis are the same axis.

27. A refractory bottom lining according to claim 17, wherein said uppermost surface section is sloped.

28. A refractory bottom lining according to claim 17, wherein at least one of said at least two intermediate surface sections is sloped.

* * * * *